US010493490B2

(12) United States Patent
Tapia De La Fuente et al.

(10) Patent No.: US 10,493,490 B2
(45) Date of Patent: Dec. 3, 2019

(54) METHOD FOR THE PRODUCTION OF A METAL PANEL AND RESULTING METAL PANEL

(75) Inventors: Carlos Tapia De La Fuente, Astrain (ES); Beatriz Lerga Lamarique, Astrain (ES); Yolanda Garces Inunez, Astrain (ES)

(73) Assignee: RECUBRIMIENTOS PLASTICOS, S.A., Astrain (Navarra) (ES)

( * ) Notice: Subject to any disclaimer, the term of this patent is extended or adjusted under 35 U.S.C. 154(b) by 502 days.

(21) Appl. No.: 14/123,785

(22) PCT Filed: Nov. 18, 2011

(86) PCT No.: PCT/ES2011/070795
§ 371 (c)(1),
(2), (4) Date: Dec. 4, 2013

(87) PCT Pub. No.: WO2012/172130
PCT Pub. Date: Dec. 20, 2012

(65) Prior Publication Data

US 2014/0106123 A1 Apr. 17, 2014

(30) Foreign Application Priority Data

Jun. 14, 2011 (ES) ..... 201130986

(51) Int. Cl.

| | |
|---|---|
| ***B05D 7/16*** | (2006.01) |
| ***C23C 26/00*** | (2006.01) |
| ***B05D 5/06*** | (2006.01) |
| ***B05D 3/12*** | (2006.01) |

(52) U.S. Cl.
CPC ..... *B05D 7/16* (2013.01); *B05D 5/067* (2013.01); *C23C 26/00* (2013.01); *B05D 3/12* (2013.01); *B05D 2202/15* (2013.01); *Y10T 428/24364* (2015.01)

(58) Field of Classification Search
CPC ..... C23C 26/00; B05D 5/167; B05D 7/16; B05D 3/12; B05D 2202/15
See application file for complete search history.

(56) References Cited

U.S. PATENT DOCUMENTS

| | | | | |
|---|---|---|---|---|
| 2001/0000482 | A1* | 4/2001 | Sugimoto | B32B 15/08 428/461 |
| 2008/0003446 | A1* | 1/2008 | Furukawa | B05D 7/14 428/612 |
| 2009/0087649 | A1* | 4/2009 | Colaiacovo | C08G 18/0852 428/336 |
| 2011/0262768 | A1* | 10/2011 | Jahrling | B05D 1/62 428/623 |

FOREIGN PATENT DOCUMENTS

| | | | | |
|---|---|---|---|---|
| DE | 100 22541 | A1 | 9/2001 | |
| DE | 10022541 | A1 * | 9/2001 | B05D 3/12 |
| EP | 2 042 533 | A2 | 4/2009 | |
| EP | 2 157 208 | A1 | 2/2010 | |
| ES | 2 310 112 | A1 | 12/2008 | |
| WO | WO 2008104611 | A1 * | 9/2008 | C25D 5/36 |

OTHER PUBLICATIONS

Stone, Christopher, Mechanical Finishing of Stainless Steel, Nov. 2009, Welding Design and Fabrication, http://weldingdesign.com/operations/mechanical-finishing-stainless-steel accessed Mar. 29, 2017.*

USGS Mineral Resources Program, Chromium—Makes Stainless Steel Stainless, US. Dept of the Interior, Fact Sheet 2010-3089, Sep. 2010. (Year: 2010).*

International Search Report of PCT/ES2011/070795 dated Mar. 22, 2012.

* cited by examiner

*Primary Examiner* — Kelly M Gambetta
(74) *Attorney, Agent, or Firm* — Lucas & Mercanti, LLP

(57) ABSTRACT

The invention relates to a method for the production of a metal panel, in which: at least one of the surfaces of a sheet of chromium (Cr) stainless steel, having a thickness of 0.1-2.00 mm, is subjected to a mechanical smoothing and/or glazing and/or grinding treatment until a surface roughness $R_a$ of 0'06÷1 μm is obtained with a pre-determined mark/drawing; a transparent primer/coating of adhesive or lacquer is applied to said surface; and the primer/coating is polymerised. The invention also relates to the metal panel obtained using the aforementioned method, comprising: a sheet of chromium (Cr) stainless steel, having a thickness of 0.1-2.00 mm and having at least one smoothed and/or glazed and/or ground surface with a roughness $R_a$ of between 0'06÷1 μm, said roughness having a pre-determined mark/drawing; and a cured, transparent primer/coating of adhesive or lacquer on the aforementioned surface.

9 Claims, No Drawings

METHOD FOR THE PRODUCTION OF A METAL PANEL AND RESULTING METAL PANEL

CROSS REFERENCE TO RELATED APPLICATION

This Application is a 371 of PCT/ES2011/070795 filed on Nov. 18, 2011, which claims the priority of Spanish Patent Application No. P201130986 filed on Jun. 14, 2011, which applications are incorporated herein by reference in their entirety.

Nowadays, stainless steel continues to be one of the most highly-consumed materials in the electrical appliance sector which, in spite of the introduction of numerous imitations, continues to be in great demand. Not only the electrical appliance sector shows its interest in these types of finishes, but also other aesthetic sectors such as furniture, decoration, lifts, shipbuilding sector and even the healthcare sector, the latter with a totally different use.

Therefore, stainless steel is one of the materials whose demand has grown exponentially in recent years.

Nevertheless, in spite of its fine aesthetic appearance, stainless steel is invariably a metal that is excessively cold to the touch, with a strong tendency to mark fingerprints on its surface, once it is touched. It is for this reason that continuous and frequently tedious cleaning becomes necessary with a multitude of household products, which on many occasions are not capable of easily removing the print deposited. This makes stainless steel a product that is in the high range, but whose diverse aesthetic features do not correspond to the practicality required in its habitual use—domestic (such as electrical appliances) and public (such as rails for escalators, lifts).

The problem is that its price continues to be elevated, as the substrate is stainless steel. On the other hand, its great advantage is the aesthetic appearance of metal, the possibility of different designs and different functionalities.

In order to reduce the Price, it has been necessary to resort to low-alloy stainless steels, resulting in the new problem of surface oxidation.

To prevent this oxidation, coatings have been used; thus, lower-alloy, and therefore more economical stainless steel can be used, without harming the behaviour to corrosion and even increasing the UV resistance.

Products are already known that are obtained with said coating technique, such as Patent EP0686501 of multi-coat system applied on galvanized steel, aluminium and/or zinc plating, and whose coating is performed with a coat of paint.

This problem with this type of product is that the aesthetic appearance obtained is not suitable.

The applicant has studied the problem in the laboratory, and has reached the conclusion that said unsuitable aesthetic presence resides in the fact that the appearance of the final product is provided by the paint that covers the substrate it is applied upon; that is, that the user perceives paint and does not perceive the stainless steel surface.

The applicant also considers it essential to improve the aesthetics of the actual stainless steel sheet surface, and in order to do this, the surface is modified with a mechanical treatment of smoothing, grinding and/or glazing which provides a surface that is uniform with a pre-established design, obtaining wrinkles that range from 0'06 μm to 1 μm, thus obtaining incomparably better aesthetic appearance.

In turn, the applicant has confirmed that only smoothing or glazing of the material (although providing the desired aesthetic appearance) removes the surface chrome oxides, which causes accelerated corrosion on the material, in the form of pitting.

The applicant has found the way to maintain the splendid surface aesthetic appearance obtained after the mechanical treatment and at the same time, to ensure that this surface does not corrode.

To this end, once said appearance is obtained, the final product of the applicant maintains it, so that the user perceives the bluish, whitish or yellowish tones, as well as the design/drawing and the different wrinkles of the stainless steel surface. To obtain this, the product of the applicant incorporates a/some transparent coating/s which is/are applied to said stainless steel surface.

Specifically, this surface is covered at least with a transparent coating/primer with a thickness of 15÷50 μm.

The sheet metal must be of chromium stainless steel of ferritic or austenitic nature.

The process and product of manufacturing of a metal panel according to this invention, is characterized in that:

a) a sheet of chromium (Cr) stainless steel with a thickness of 0.1-2.00 mm. is subjected, at least on one of its faces, to a mechanical treatment of smoothing and/or glazing and/or grinding until obtaining a surface roughness $R_a$ of 0'06÷1 μm with predetermined mark/drawing, and on it b) a transparent coating/primer is applied of adhesive or lacquer and c) the coating/primer is polymerised.

Description of the Process in General

The process consists of the following phases:

1) The metal base is a stainless steel (its mechanical characteristics, elastic limit, breaking strength and elongation cover all the values of the rule), of a thickness between 0.10-2.00 mm and which is dry sanded or wet sanded (with 280 to 600 grit sandpaper) and/or ground and/or glazed mechanically at a speed of between 10 and 20 m/min to obtain a specific roughness, finish and degree of metal colour.

2) The material obtained is treated chemically with a series of cleaning baths, chemical degreasing and washings with water.

3) Application of a transparent adhesive on the ground and/or glazed face, on the basis of a polyester, acrylic or polyurethane resin, of 15 to 50 wet microns (before curing), 4) Polymerization of the adhesive in an oven to reach a metal temperature from 180 to 220° C. for the evaporation of the solvents and, optionally, application of a polyester, polybutyral, epoxy or polyurethanic primer on the lower or unexposed face or of a chemical treatment in water base with adhesion to polyurethane foams.

5) Application of a PET film with a thickness of 15 to 30 microns to obtain the total sealing of the product and, finally, its refrigeration.

As a second option, instead of adhesive and PET sheet, an acrylic lacquer or polyester, transparent, can be applied on the ground stainless steel in a coat of around 10-20 wet microns (before the curing), with a polyester, polybutyral, epoxy or polyurethanic primer on the lower face or unexposed part, optionally.

The material is put into the oven which can reach a metal temperature of 210-250° C. to cure the coating. Subsequent refrigeration of the material with water and air.

6) (2nd Optional phase) Optionally, a protective film can be placed after the application of the PET film (or of the lacquer) with the purpose of protecting the coating in its formation and handling at customer.

The product resulting from this process shows substantial improvements in comparison to a conventional product and in comparison to the product of the Patent EP0686501, as shown in the following tests.

| Tests | Conventional Product | Product of the invention |
|---|---|---|
| ECCA T4 Hardness pencil | H | >H with lacquer >3H with PET film |
| ECCA T6 (embossing Erichsen) | up to 7 mm | larger than 8 mm |
| ECCA T7 Bending resistance | 0.5-1T (cracking substrate) | 0T without cracking |
| ECCA T8 Corrosion resistance in Salt spray chamber | 190 h | >400 hours |
| ECCA T11 Resistance to MEK | Marks and leaves circles | no circle or remains >100 rubs |
| ECCA T13 Heat aging resistance | 200 h to 120° C. | 500 h to 120° C. |
| ECCA T18 Stain resistance* after 16 hours | Surface not uniform, attacked after cleaning | Surface clean and not attacked |

*butter, oil, petrol, lipstick, tea, coffee, shoe polish, tomato, mustard, chocolate . . .

EXAMPLES

Example 1

Substrate: Ferritic stainless steel AISI 430 and a thickness of 0.60 mm.

Texturing process: Process of grinding with 320 grit sandpaper, and subsequent glazing, roughness Ra=0.20 microns, Glazing applied on the substrate mechanically by sanding cloths in a standardized grade with the market name "Scotch Brite", obtaining colour, in range b=3 (coordinates CIE Lab).

Chemical treatment: chemical cleaning with a series of degreasings and washings with water.

Application of liquid organic coating: application of a polyester adhesive (25 microns) on the exposed face and of an epoxy primer (10 microns) on the unexposed face. Curing of the product in oven at a metal temperature of 220° C.

Application of PET film: application of a glossy 20-micron PET film

Application protective film: application of a protective film (50 microns thickness).

Example 2

Substrate: AISI 430 stainless steel, 0.7 mm thickness, with a roughness of Ra=0.8 microns, glazed with cork sanding blocks and gloss of substrate obtained of 110-130%.

Alkaline degreasing and washing of the metal substrate, with a bath of tap water and another bath with demineralised water.

Application on the substrate of an acrylic lacquer in solvent base or water base (15 microns thickness wet) and cured in convection oven at PMT=224° C.

Application of the protective film with thickness 40 microns to better handle the final product.

Example 3

Substrate: AISI 430 stainless steel 0.8 mm thick and finished with a roughness of Ra=0.15 microns.

Grinding and smoothing with 400 grit sandpapers on metal.

Chemical treatment: chemical cleaning with two degreasings and two washings, the last with demineralised water with conductivity of less than 50 μS/cm.

Application of a chemical treatment in water base on the lower or unexposed face, facilitating the adhesion of polyurethane foams.

Application of liquid organic coating: application of a polyester adhesive (15 microns) on the exposed face. Curing of the product in oven at metal temperature of 220° C.

Application PET film: application of a matte antibacterial PET film 20 microns thick.

The control of the gloss is done with dulling agents on the lacquer or the PET film, so that the gloss obtained at will ranges from 40% to >100% depending on the final requirements of the customer.

With this product, an important improvement is obtained of aging in salt spray chamber of up to 700 hours as well as easy cleaning of the surface without leaving marks or circles of the conventional cleaning products, providing a completely uniform surface after its cleaning with a soft cloth and water.

The procedure and the product obtained are totally flexible with an infinite variety of textured finishes according to mechanical process, colours and appearance various with the organic coatings, personalized for each customer and sector.

With the grinding, smoothing and the glazing with glazing sandpapers of different grit sizes and composition, and depending on the sets and combinations of sandpapers, cork, graphite, etc., various finishes of roughness and outlines/drawings are obtained.

Depending on whether the processes are performed dry or wet, the colour and its tones of yellow, bluish, and whitish may vary at will, which, when combining it with the different roughnesses and outlines, offers a great versatility in the offer to the user.

The invention claimed is:

1. A method of manufacturing of a metal panel, the method comprising:

forming a metal panel that comprises not more than one metallic layer having a selected color tone by:

a) obtaining a sheet panel of chromium (Cr) stainless steel with a thickness of 0.1-2.00 mm;

b) subjecting at least one face of the sheet panel of chromium (Cr) stainless steel obtained from step a) to a mechanical grinding with a 280-600 grit abrasive medium at a speed of 10-20 m/min until obtaining a surface roughness of the sheet panel of chromium (Cr) stainless steel $R_a$ of 0.06-1.0 μm and maintaining a degree of metal color from blue, white or yellow tones of the stainless steel;

c) applying a transparent coating of adhesive or lacquer to the panel of chromium (Cr) stainless steel subjected to mechanical grinding from step b); and d) polymerizing the coating applied in step c).

2. The method of manufacturing of a metal panel, according to claim 1, wherein the grinding is performed using one of a sanding cloth, sandpaper, or cork.

3. The method of manufacturing of a metal panel, according to claim 1, wherein the coating is an adhesive in polyester, acrylic or polyurethanic base.

4. The method of manufacturing of a metal panel, according to claim 1, wherein the coating is a lacquer in acrylic and/or polyester base, which fills the holes of the smoothing of the substrate creating an impermeable sheet.

5. The method of manufacturing of a metal panel, according to claim 1, wherein the coating is applied, in solvent base or in water base, on the back or unexposed face, which facilitates adhesion to the polyurethane foams, normally used in the electric appliance sector.

6. The method of manufacturing of a metal panel, according to claim 1, wherein a PET film is applied as coating which seals the unit.

7. The method of manufacturing a metal panel, according to claim 1, wherein the surface roughness of the sheet panel of chromium (Cr) stainless steel $R_a$ of 0.06-0.45 μm is obtained.

8. A method of manufacturing a metal panel comprising:

forming a metal panel that comprises not more than one metallic layer having a selected color tone by:

a) obtaining a sheet panel of chromium (Cr) stainless steel with a thickness of 0.1-2.00 mm;

b) subjecting the sheet panel of chromium (Cr) stainless steel obtained from step a) to a mechanical treatment of wet or dry smoothing with sandpaper having 280-600 grit, at a speed of 10-20 m/min until obtaining a surface roughness of the sheet panel of chromium (Cr) stainless steel $R_a$ of 0.06-1.0 μm and maintaining a degree of metal color from blue, white or yellow tones of the stainless steel panel;

c) applying a transparent coating of adhesive or lacquer having 15-50 wet microns to the stainless steel panel subjected to mechanical treatment in step b) prior to curing;

d) polymerizing the coating applied in step c) at a temperature range of 180-250° C.; and e) thereafter applying a PET film with a thickness of 15-30 μm.

9. The method of manufacturing of a metal panel, according to claim 1, wherein the temperature range in step c) is 180-220° C.

* * * * *